US009211978B2

(12) United States Patent
Fox

(10) Patent No.: US 9,211,978 B2
(45) Date of Patent: Dec. 15, 2015

(54) SEAL

(75) Inventor: Jamie Fox, Norfolk (GB)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 207 days.

(21) Appl. No.: 13/641,960

(22) PCT Filed: Apr. 26, 2011

(86) PCT No.: PCT/GB2011/000643

§ 371 (c)(1),
(2), (4) Date: Oct. 18, 2012

(87) PCT Pub. No.: WO2011/135292

PCT Pub. Date: Nov. 3, 2011

(65) Prior Publication Data

US 2013/0032565 A1 Feb. 7, 2013

(30) Foreign Application Priority Data

Apr. 27, 2010 (GB) ..... 1007023.3

(51) Int. Cl.

| | |
|---|---|
| ***B65D 41/04*** | (2006.01) |
| ***B65D 47/20*** | (2006.01) |
| ***B65D 51/00*** | (2006.01) |
| ***B65D 51/20*** | (2006.01) |
| ***B65D 51/22*** | (2006.01) |
| ***B65D 53/04*** | (2006.01) |

(52) U.S. Cl.

CPC ..... *B65D 41/045* (2013.01); *B65D 47/2031* (2013.01); *B65D 51/002* (2013.01); *B65D 51/005* (2013.01); *B65D 51/20* (2013.01); *B65D 51/224* (2013.01); *B65D 53/04* (2013.01); *B65D2251/0015* (2013.01); *B65D 2251/0093* (2013.01)

(58) Field of Classification Search

CPC ..... B65D 9/00; B65D 51/00; B32B 9/06
USPC ..... 215/347, 232, 247, 310, 363, 349, 249, 215/258, 341; 428/40.1; 220/258
See application file for complete search history.

(56) References Cited

U.S. PATENT DOCUMENTS

| | | | | |
|---|---|---|---|---|
| 4,773,552 | A * | 9/1988 | Boege | B65D 51/002 215/247 |
| 4,778,698 | A * | 10/1988 | Ou-Yang | 428/34.4 |
| 4,863,061 | A * | 9/1989 | Moore | 220/258.2 |
| 4,896,782 | A | 1/1990 | Hawkins et al. | |
| 5,012,946 | A | 5/1991 | McCarthy | |
| 5,513,781 | A | 5/1996 | Ullrich et al. | |
| 7,824,921 | B1 * | 11/2010 | Levy | 436/180 |

(Continued)

FOREIGN PATENT DOCUMENTS

| | | |
|---|---|---|
| DE | 4020371 C1 | 12/1991 |
| EP | 1462381 A1 | 9/2004 |

(Continued)

OTHER PUBLICATIONS

British Intellectual Property Office Search Report for Application No. GB1007023.3, dated Aug. 19, 2010.

(Continued)

*Primary Examiner* — Anthony Stashick
*Assistant Examiner* — Raven Collins
(74) *Attorney, Agent, or Firm* — McDonnell Boehnen Hulbert & Berghoff LLP

(57) ABSTRACT

A pierceable, induction sealable seal for a container opening, the seal comprising a plurality of layers at least one of which is metallic and at least one of which is non-metallic, at least one of the non-metallic layers is complete and in use extends across a container opening to seal it. The area over which the at least one of the metallic layers extends is restricted to the region of the periphery of the seal whereby to facilitate induction sealing to the opening but to remain isolated from product in a container upon piercing of the seal.

18 Claims, 10 Drawing Sheets

(56) References Cited

U.S. PATENT DOCUMENTS

| | | | | |
|---|---|---|---|---|
| 7,951,109 | B2 * | 5/2011 | Anderson | 604/87 |
| 7,960,001 | B2 * | 6/2011 | Yousif et al. | 428/40.1 |
| 2006/0054584 | A1 * | 3/2006 | Jackman | 215/347 |
| 2006/0124578 | A1 | 6/2006 | Yousif et al. | |

FOREIGN PATENT DOCUMENTS

| | | | |
|---|---|---|---|
| EP | 2036829 | A1 | 3/2009 |
| GB | 2117362 | A | 10/1983 |
| GB | 2162158 | A | 1/1986 |
| GB | 2416535 | A | 2/2006 |
| WO | 2009/117326 | A1 | 9/2009 |

OTHER PUBLICATIONS

International Search Report and Written Opinion for Int. Appl. No. PCT/GB2011/000643, mailed Aug. 11, 2011.

* cited by examiner

SEAL

CROSS REFERENCE TO RELATED APPLICATIONS

The present application is a U.S. National Phase Application pursuant to 35 U.S.C. §371 of International Application No. PCT/GB2011/000643 filed Apr. 26, 2011, which claims priority to British Patent Application No. 1007023.3 filed on Apr. 27, 2010. The entire disclosure contents of these applications are herewith incorporated by reference into the present application.

FIELD OF THE INVENTION

The present invention relates generally to a seal for a container and particularly to a seal which is intended to be pierced in order to allow access to product in a container.

BACKGROUND

It is known to provide container seals for preserving the contents of the container prior to opening. In many cases the seal is pierced to gain access to the product. When the seal is pierced, the material of the seal may come into direct contact with the product. Depending on the type of seal there may be certain layers which must be present in order to provide it with certain properties, such as the ability to be sealed to the rim of the container and the ability to prevent ingress and/or egress of material to and from the product. These requirements may conflict with the desire to avoid contact of certain materials in the seal with the product.

SUMMARY

The present invention seeks to address the problems with known container seals.

According to a first aspect of the present invention there is provided a pierceable, induction sealable seal for a container opening, the seal comprising a plurality of layers at least one of which is metallic and at least one of which is non-metallic, at least one of the non-metallic layers is complete and in use extends across a container opening to seal it, in which the area over which the at least one of the metallic layers extends is restricted to the region of the periphery of the seal whereby to facilitate induction sealing to the opening but to remain isolated from product in a container upon piercing of the seal.

By having one or more layers with incomplete coverage, the material from the seal which is torn and pushed down during piercing can be controlled. Therefore material which may be incompatible with a product in a container can be present but isolated from the product following piercing. One of the layers is complete. In other words, the layer may extend over substantially the entire area of the seal when viewed in plan or at least over the entire area of a container opening.

The restricted layer(s) may be restricted to the region of the periphery of the liner. This is particularly useful where the layer(s) are involved in fixing the seal to a container rim and/or sealing because they may only be required at the periphery.

The restricted layer(s) may be formed as an annulus. The annulus may therefore define a piercing zone at its centre which does not include any material from the restricted layer(s).

The seal may include a layer of polyethylene terephthalate (PET). The layer of PET may be complete.

The liner may include a layer of aluminium. Aluminium or a similar conductive material may be required for certain applications, such as when the seal will be induction welded to the container rim. The layer of aluminium may be incomplete.

The seal may include a layer of foam such as foamed polyethylene or polypropylene. The layer of foam may be incomplete.

The layers may be secured to each other by adhesive, wax or the like. In use one or more of the layers may separate from each other. For example, some layers may remain on a container and others may be retained in an associated closure.

The seal may be formed as a liner for a container closure. The closure may be a self-piercing closure, with a mechanism for piercing through the seal.

The seal may be formed as an induction seal liner, for example a heat induction sealed liner.

According to a further aspect there is provided a seal as described herein in combination with a container.

According to a further aspect there is provided a seal as described herein in combination with a closure. The closure may be a self-piecing closure.

BRIEF DESCRIPTION OF THE DRAWINGS

The present invention will now be more particularly described, by way of example, with reference to the accompanying drawings, in which.

DETAILED DESCRIPTION

Figure 1:
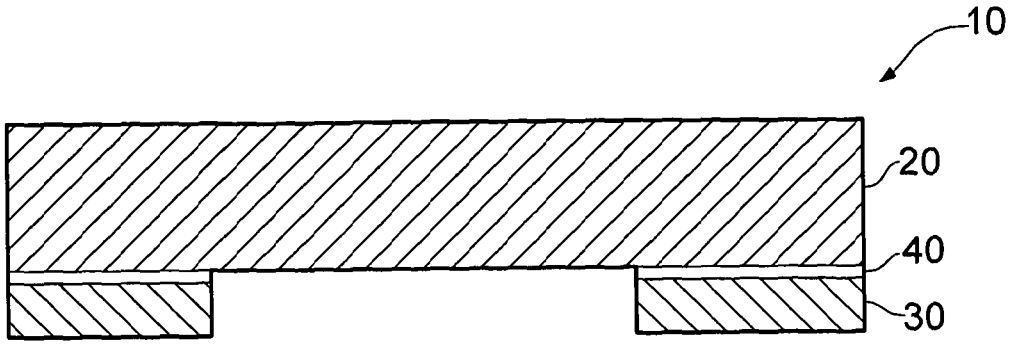
FIG. 1 is a section of a seal formed according to an embodiment of the present invention.
Figure 2:
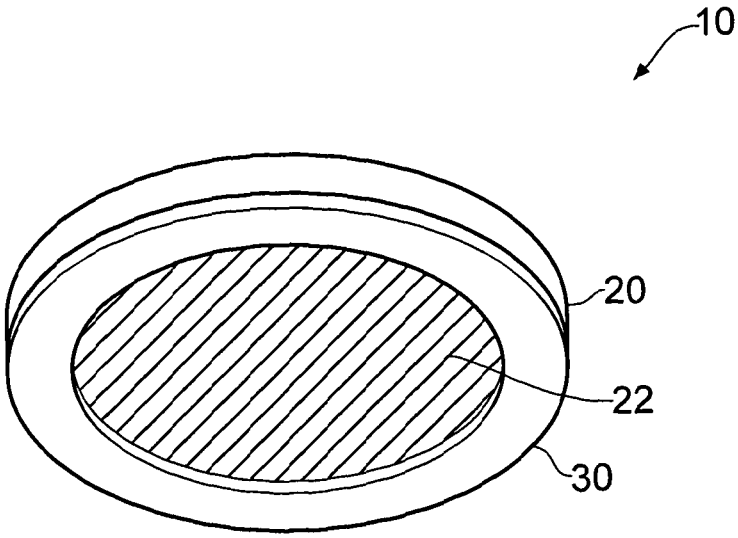
FIG. 2 is a bottom perspective view showing the underside of the seal of FIG. 1.

Referring first to FIG. 1 there is shown a disc-shape seal generally indicated 10. The seal 10 comprises a layer of polyethylene terephthalate (PET) 20 and a layer of foam 30 secured to each other by a layer of adhesive 40.

The PET layer 20 is complete, in other words it extends completely over the area of the seal in plan. The foam layer 30 is formed as an annulus secured to the underside of the PET layer. Accordingly the layer 30 is incomplete and defines a central region 22 of the PET layer over which the foam layer 30 does not extend.

Figure 3:
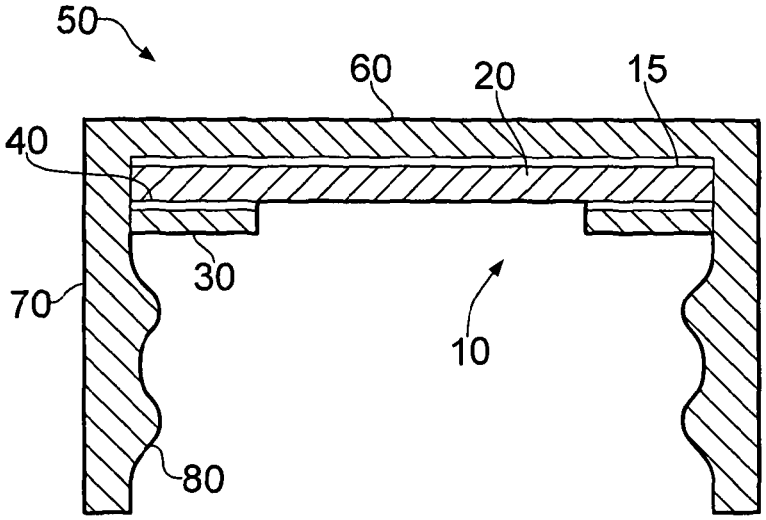
FIG. 3 is a section of the seal of FIGS. 1 and 2 shown fitted into a closure as a liner.

Referring now to FIG. 3, the seal 10 is shown to be formed as a liner and 10 is secured into the top of a closure generally indicated 50. The closure 50 comprises a disc-shape top plate 60 with a cylindrical skirt 70 depending from the periphery thereof. The skirt 70 includes screw thread formations 80. The seal 10 is weakly adhered to the underside of the top plate 60 by an adhesive layer 15 on top of the PET layer 20.

Figure 4:
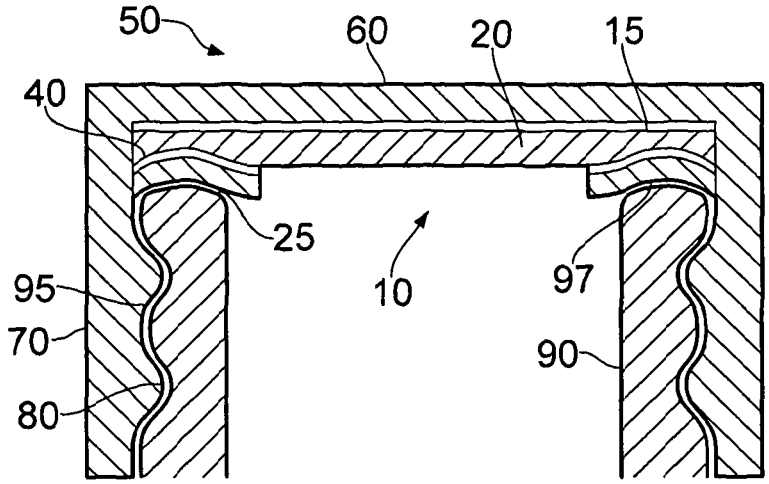
FIG. 4 is a section of the closure/seal of FIG. 3 shown attached to a container neck.

In FIG. 4 the closure 50 is shown applied to a container neck 90. The closure is applied using screw thread formations 95 on the neck corresponding to the formations 80 on the closure.

To secure the seal 10 to the container rim 97, heat curable adhesive 25 is applied to the rim before application of the closure. Subsequently heat is applied to the top plate 60 to cure the adhesive which bonds the foam layer 30 to the rim 97.

With the closure fully applied to the liner, in particular the foamed layer 30, is compressed and forms a seal around the container neck 90. The heating process also weakens/removes the adhesion between the PET layer 20 and the top plate 60 by at least partly melting the adhesive layer 15.

Figure 5:
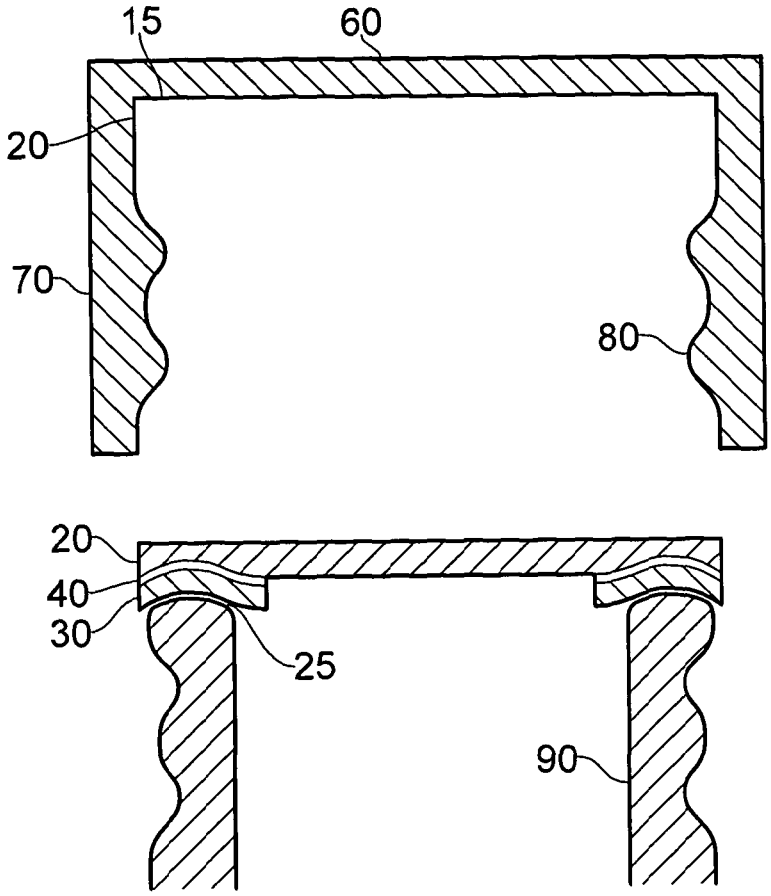
FIG. 5 is a section of the closure/seal/container of FIG. 4 following first removal of the closure.

FIG. 5 shows the closure and container neck following first removal of the closure. Because the adhesive layer 15 is weakened/removed, when the closure 50 is unscrewed the seal 10 remains on the container neck 90.

Figure 6:
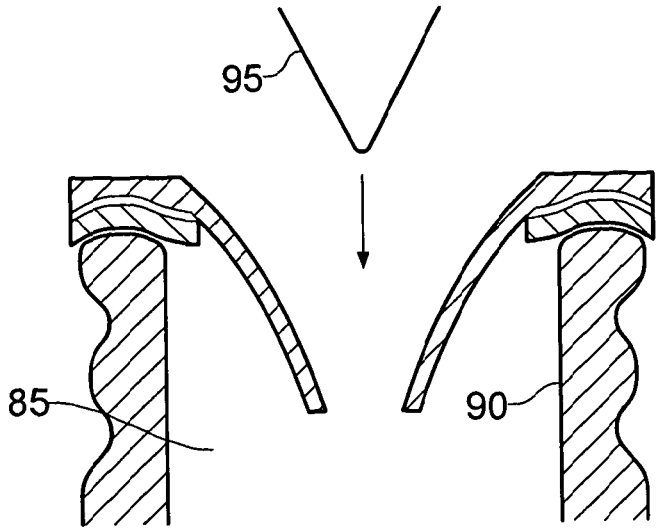
FIG. 6 is a section of the container/seal of FIG. 6 following piercing of the seal.

When access to the contents of the container 90 is required the seal must be pierced. In this embodiment, the seal is pierced by a separate tool 95 as shown in FIG. 6. It will be seen that as the central region of the seal is torn by the tool it will be pushed into the mouth of the container.

Because the foam layer 30 is restricted to the periphery of the seal, this layer will not be pushed into the container mouth and will not potentially come into contact with the product. Therefore only the PET layer 20 will potentially contact the product 85.

Figure 7:
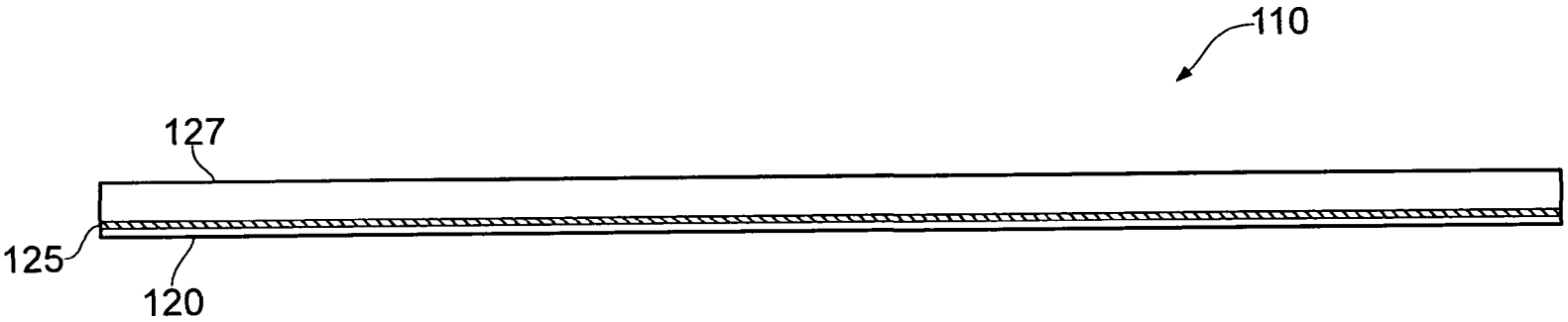
FIG. 7 is a side elevation of a seal formed according to an alternative embodiment of the present invention.
Figure 8:
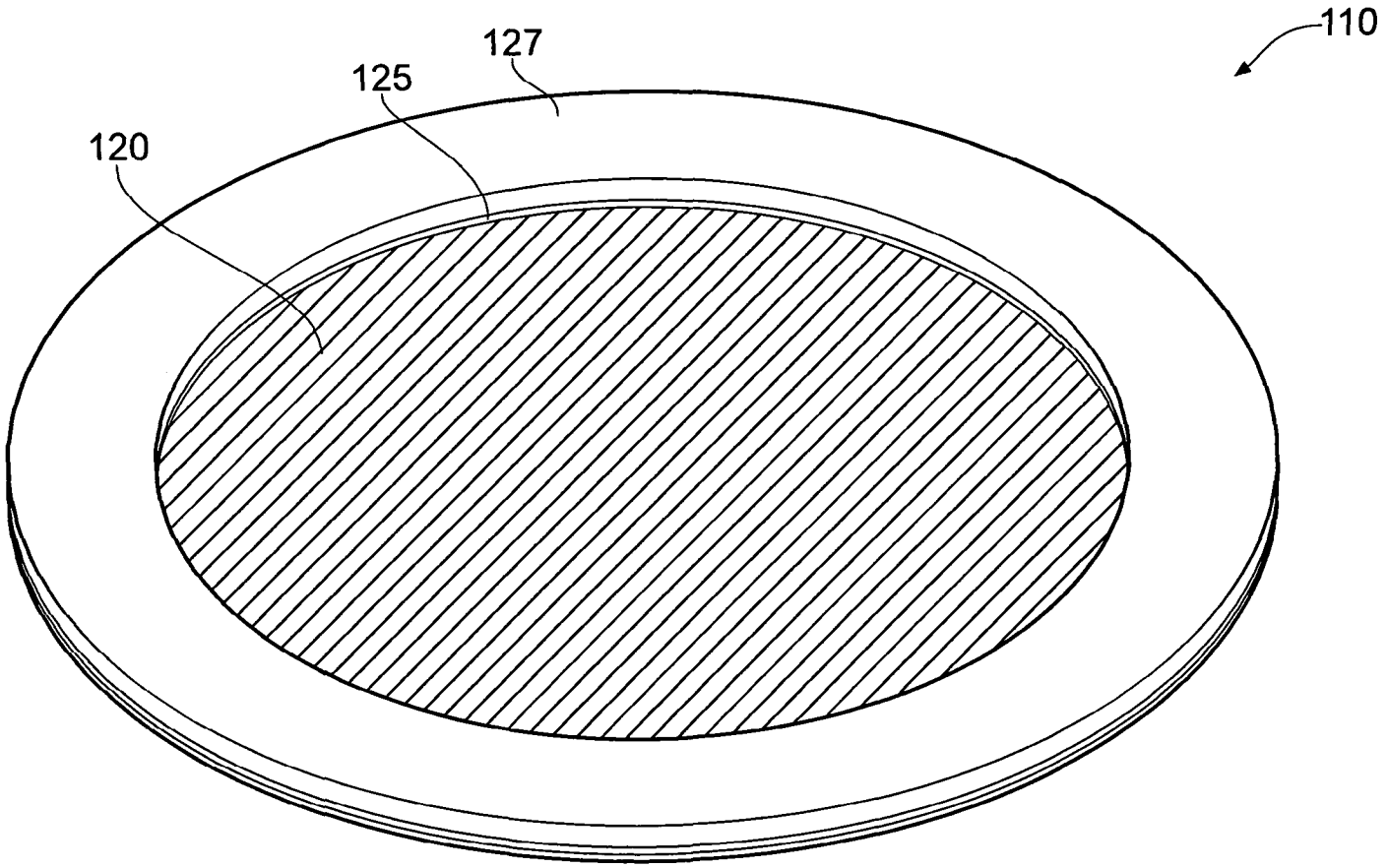
FIG. 8 is a top perspective view of the seal of FIG. 7.

Referring now to FIGS. 7 and 8 there is shown a seal 110 formed according to an alternative embodiment. The seal comprises a layer of PET 120, a layer of aluminium foil 125 and a layer of foamed polyethylene 127. The layer of PET 120 is formed as a complete disc, whereas the aluminium and foam layers 125, 127 are formed as rings which extend around the peripheral region of the PET layer.

The PET layer is present as a barrier layer, to prevent ingress of gases which are deleterious to the container product.

The foam layer is present to form a physical seal around the container rim when a closure is applied.

The aluminium layer is required to attach the seal to a container rim.

Figure 9:
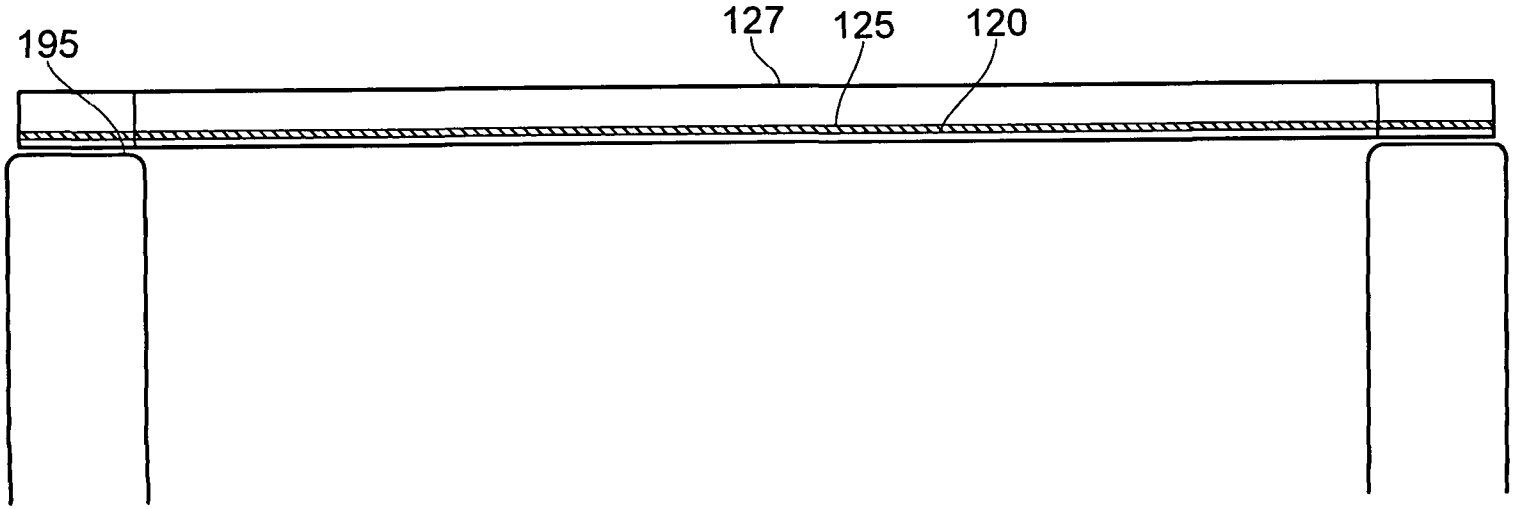
FIG. 9 is a side view of the seal of FIGS. 7 and 8 shown attached to a container neck rim.

The seal is formed as a heat induction sealed liner therefore in the first instance is fitted into a closure, which in this embodiment is a self-piercing closure (not shown). In use the closure is fitted onto a container neck so that the PET layer 120 abuts and fits around the top of the container neck rim 195 as shown in FIG. 9. Thereafter the seal is secured to the container rim by a heat induction process. The induction process requires the aluminium layer to facilitate bonding of the PET layer to the container rim.

Figure 10:
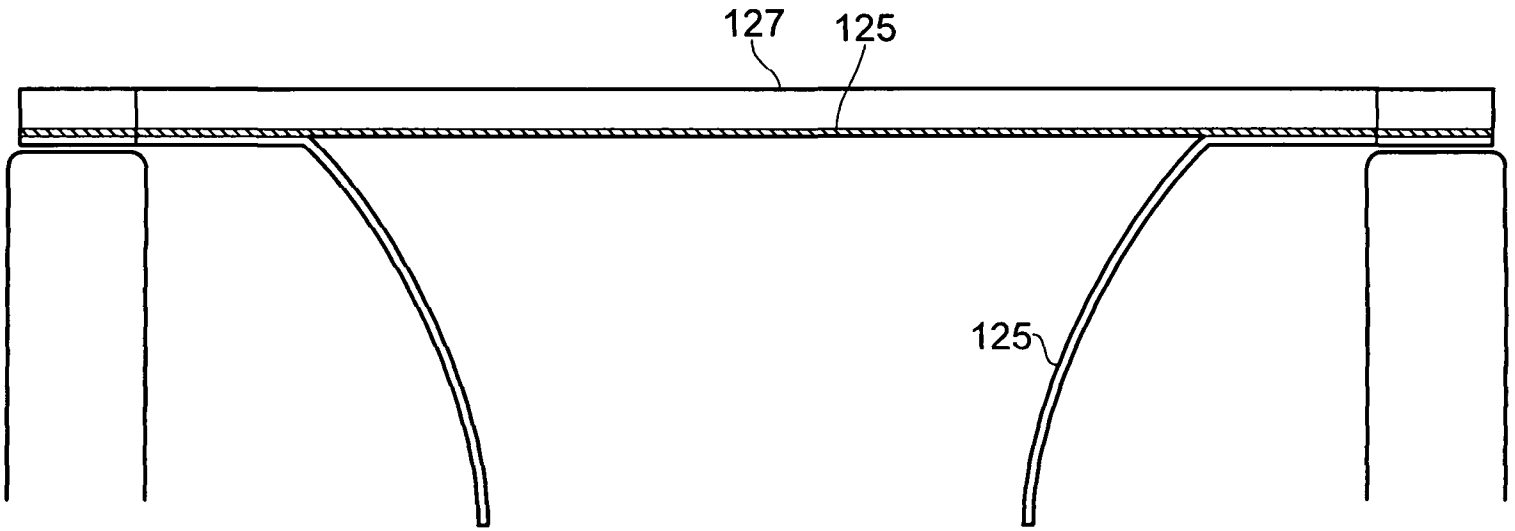
FIG. 10 is a partial section of the seal of FIG. 9 shown following piercing.

Subsequently, when the self-piercing closure is activated the seal will be pierced. However, because the aluminium and foam layers 125, 127 are restricted to the periphery of the seal, only the PET layer is in fact pierced and pushed down into the mouth of the container as shown in FIG. 10. Therefore, only the PET layer 120 will come into contact with product in the container.

Figure 11:
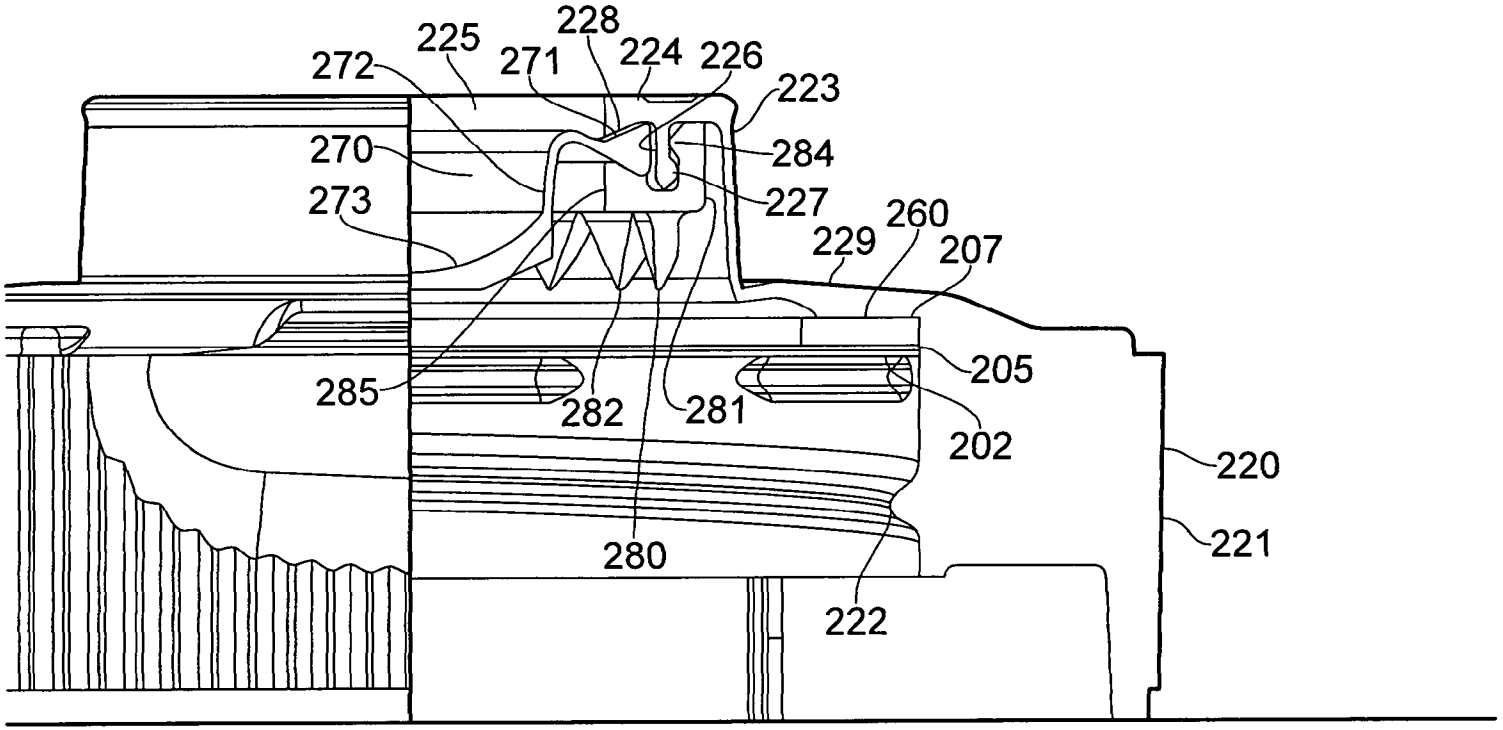
FIG. 11 is a partial section of a closure incorporating a liner formed according to the present invention.
Figure 12:
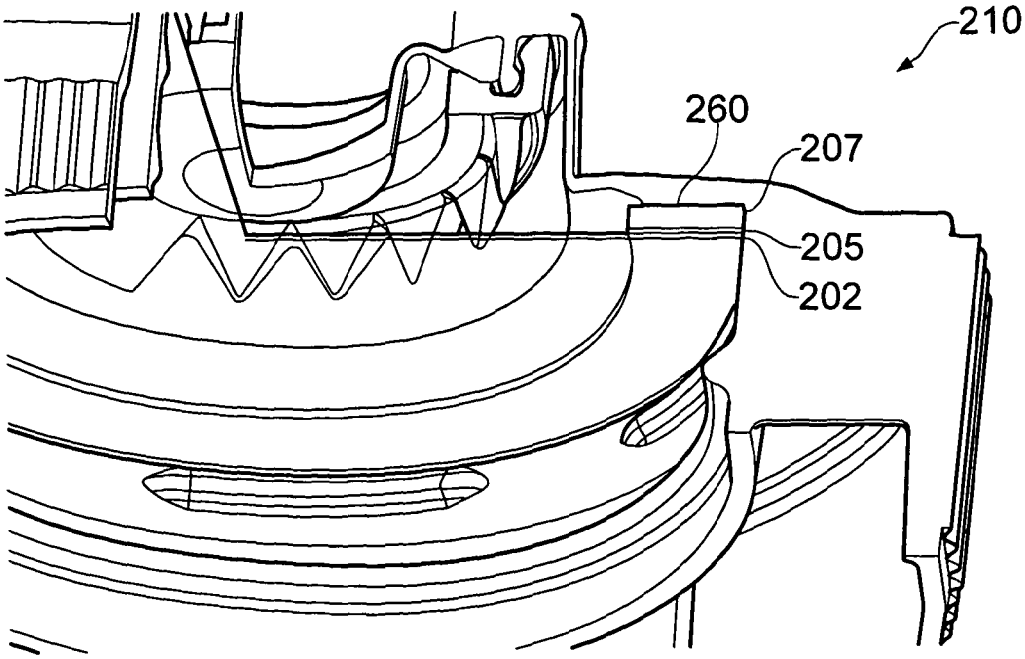
FIG. 12 is a perspective section of the closure of FIG. 11.
Figure 13:
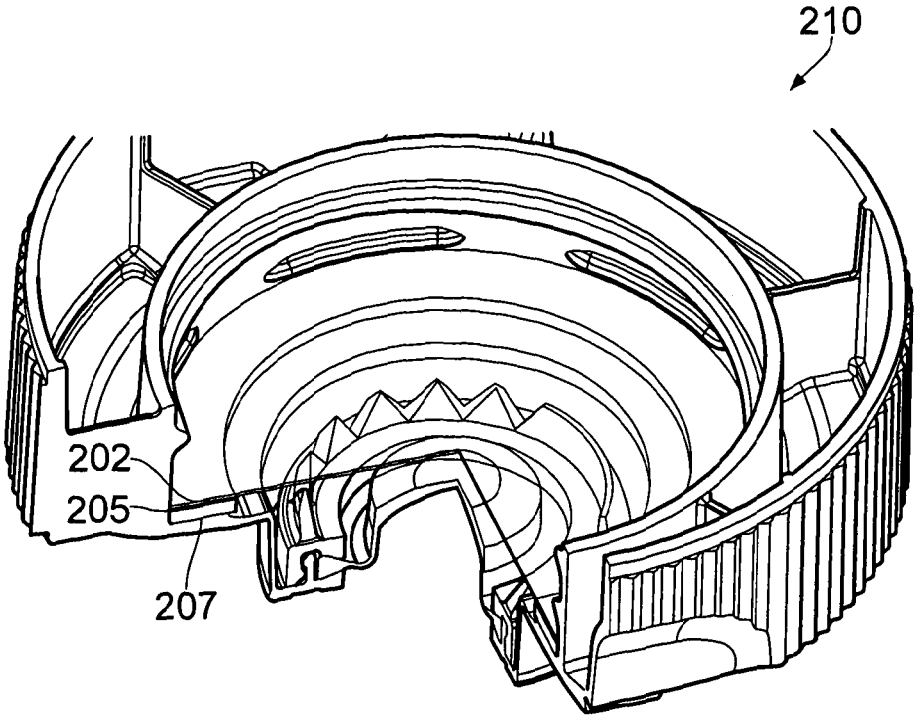
FIG. 13 is a further section of the closure of FIG. 12.

Referring now to FIGS. 11 to 13 there is shown a closure generally indicated 210. The closure 210 comprises a generally cylindrical base 220.

The closure 210 is intended to be fitted to a container neck (not shown) which at its open end is sealed by a laminar disc-shape liner 260 which in this embodiment will be induction heat sealed into position.

The base 220 comprises a cylindrical sidewall 221 which includes internal screwthread formations 222 for engaging corresponding external screwthread formations on the container neck.

At the closed end of the sidewall, a platform 229 extends radially inwardly. From the inner edge of the platform 229 an upstanding collar 223 is provided. At the opposite end of the collar 223 to the platform 229 a sealing portion 224 extends radially inwardly and defines at its centre an aperture 225. Approximately half way along the portion 224 an annular sealing leg 226 depends and terminates with a sealing bead 227. The arm 224 terminates with a wedge-shape portion 228 which includes a downwardly depending section.

A self-closing valve 270 is provided. The valve 270 is of standard construction and briefly comprises a generally triangular section support ring 271, a J-shape connecting wall 272 and a generally disc-shape concave valve head 273.

The valve 270 is fitted into the base 220 so that the segment 271 abuts against the portion 228 and the opposingly inclined surfaces allow for a stable interaction.

A piercing member 280 is provided. The member 280 is generally annular and comprises a retention band 281 from which depends a cutting region comprising a plurality of teeth 282. At the end of the collar 281 opposite the teeth 282 a bead 284 projects radially inwardly. Extending parallel to the collar 281 on the opposite side of the teeth 282 is a retention jaw 285. In use, with the self-closing valve assembled into the base, the member 280 is snap fitted on to the base so that the bead 284 clips over the bead 227. At the same time, the jaw 285 engages the segment 271 so that it is held firmly between the portion 228 and the jaw 285. For this purpose the jaw 285 includes an inclined surface oppositely inclined to that side of the segment 271.

A liner 260 is provided and fits into the closure under the platform 229. The liner includes: an annular layer of foamed polyethylene 207 which seals against the platform; an annular layer of aluminium foil 205 attached to the layer 207; and a disc-shape layer of PET 202 attached to the layer 205.

In use the closure 210 is applied to a container neck so that the liner 260 contacts the neck rim. The liner 260 can then be induction sealed onto the neck rim.

Figure 14:
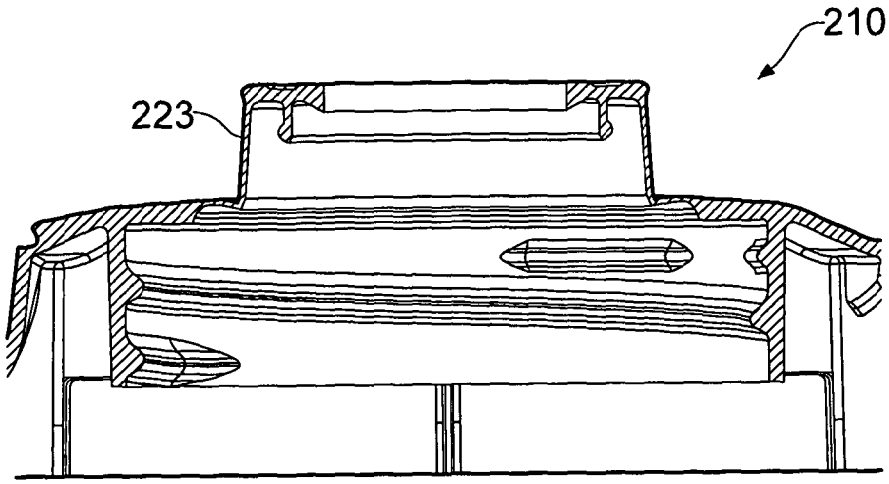
FIG. 14 is a section of a body part of the closure of FIG. 11 shown in an unactivation position.
Figure 15:
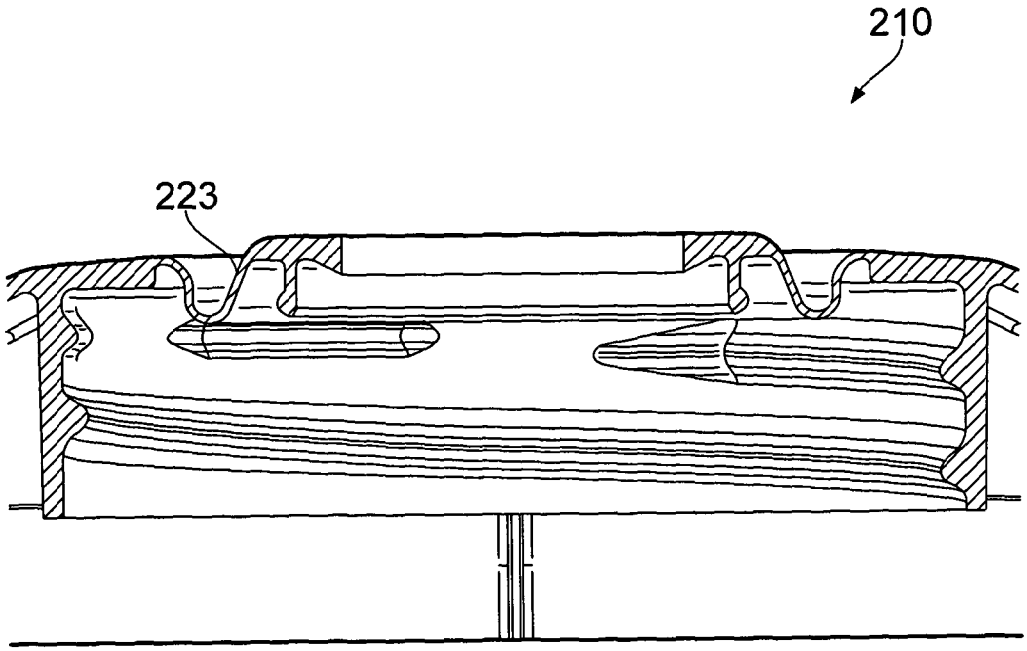
FIG. 15 is a section of the part of FIG. 14 shown in an activated position.

The neck 223 is formed as a flexible membrane so that it can be pushed down from the position shown in FIG. 14 to the position shown in FIG. 15. In doing so, the piercing member 280 is pushed down to contact the panel 260. This pierces only the PET layer 202 of the panel because the layers 207, 205 are confirmed to the peripheral region not contacted by the piercing member. Subsequently product can flow from the container under the control of the self-closing valve 270.

The invention claimed is:

1. A pierceable, induction sealable seal for a container opening, the seal comprising:

a plurality of layers at least one of which is a metallic layer and at least one of which is a non-metallic layer, at least one of the non-metallic layers is complete and in use extends across a container opening to seal the container such that at least one of the non-metallic layers is pierced and pushed down into the container opening in use, in which at least one of the metallic layers is incomplete and formed as an annulus such that the area over which the at least one of the metallic layers extends is restricted to a periphery of the seal, whereby the annular shaped at least one of the metallic layers defines a piercing zone at its centre which does not include any material from the at least one of the metallic layers and which is not pierced or pushed down into the container opening in use such that the at least one of the metallic layers facilitate induction sealing to the opening but remain isolated from product in the container upon piercing of the seal, in which the seal includes a layer of foam, and in which the layer of foam is incomplete and formed as an annulus such that the area over which the layer of foam extends is restricted to the periphery of the seal, whereby the annular shaped layer of foam defines a piercing zone at its centre which does not include any material from the layer of foam and which is not pierced or pushed down into the container opening in use.

2. The seal of claim 1, wherein the layer of foam is foamed polyethylene or polypropylene.

3. The seal of claim 1, further comprising a layer of polymeric material.

4. The seal of claim 1, further comprising a layer of PET.

5. The seal of claim 4, wherein the layer of PET is complete.

6. The seal of claim 1, further comprising a liner that includes a layer of aluminium.

7. The seal of claim 6, wherein the layer of aluminium is incomplete.

8. The seal of claim 1, wherein the plurality of layers are secured to each other by an adhesive.

9. The seal of claim 1, wherein the seal is formed as a liner for a container closure.

10. The seal of claim 1, wherein the seal is formed as a heat induction sealed liner.

11. The seal of claim 1, wherein the seal is in combination with a container.

12. The seal of claim 1, wherein the seal is in combination with a self-piercing closure.

13. The seal of claim 1, wherein the layer of foam is positioned between the incomplete at least one of the metallic layers and the complete at least one of the non-metallic layers.

14. A container closure comprising:

a liner comprising a pierceable, induction sealable seal for a container opening, the seal comprising: a plurality of layers at least one of which is a metallic layer and at least one of which is a non-metallic layer, at least one of the non-metallic layers is complete and in use extends across a container opening to seal the container such that at least one of the non-metallic layers is pierced and pushed down into the container opening in use, in which at least one of the metallic layers is incomplete and formed as an annulus such that the area over which the at least one of the metallic layers extends is restricted to a periphery of the seal, whereby the annular shaped at least one of the metallic layers defines a piercing zone at its centre which does not include any material from the at least one of the metallic layers and which is not pierced or pushed down into the container opening in use such that the at least one of the metallic layers facilitate induction sealing to the opening but to remain isolated from product in the container upon piercing of the seal, in which the seal includes a layer of foam, and in which the layer of foam is incomplete and formed as an annulus such that the area over which the layer of foam extends is restricted to the periphery of the seal, whereby the annular shaped layer of foam defines a piercing zone at its centre which does not include any material from the layer of foam and which is not pierced or pushed down into the container opening in use.

15. A self-piercing closure for a container, the closure comprising:

a closure body;

a closing member having a pierceable, induction sealable seal for an opening of the container, wherein the closing member is a laminar closing member having a plurality of layers at least one of which is a metallic layer and at least one of which is a non-metallic layer, at least one of the non-metallic layers is complete and in use extends across a container opening to seal the container such that at least one of the non-metallic layers is pierced and pushed down into the container opening in use, in which at least one of the metallic layers is incomplete and formed as an annulus such that the area over which the at least one of the metallic layers extends is restricted to a periphery of the seal, whereby the annular shaped at least one of the metallic layers defines a piercing zone at its centre which does not include any material from the at least one of the metallic layers and which is not pierced or pushed down into the container opening in use such that the at least one of the metallic layers facilitate induction sealing to the opening but to remain isolated from flowable media in the container upon piercing of the seal, in which the seal includes a layer of foam, and in which the layer of foam is incomplete and formed as an annulus such that the area over which the layer of foam extends is restricted to the periphery of the seal, whereby the annular shaped layer of foam defines a piercing zone at its centre which does not include any material from the layer of foam and which is not pierced or pushed down into the container opening in use;

a piercing mechanism configured to pierce the closing member in use; and a self-closing valve structured to dispense the flowable media from the container responsive to the closing member in use being pierced.

16. The closure of claim 15, wherein the closure body is movable from a first position to a second position to activate the piercing mechanism.

17. The closure of claim 16, wherein the closure body comprises a deformable region for allowing the closure body to move from the first to the second position.

18. The closure of claim 16, wherein the closure body is formed in the second position and moved to the first position prior to activation.

* * * * *